US007836725B2

(12) United States Patent
Lautner et al.

(10) Patent No.: US 7,836,725 B2
(45) Date of Patent: Nov. 23, 2010

(54) CONDENSER FOR AN AIR CONDITIONER

(75) Inventors: Dirk Lautner, Munich (DE); Stefan Herwig, Massenhausen (DE); Hiroyasu Shimanuki, Kariya (JP)

(73) Assignee: Denso Corporation, Kariya (JP)

( * ) Notice: Subject to any disclaimer, the term of this patent is extended or adjusted under 35 U.S.C. 154(b) by 663 days.

(21) Appl. No.: 11/887,328

(22) PCT Filed: Jun. 2, 2006

(86) PCT No.: PCT/EP2006/005295

§ 371 (c)(1),
(2), (4) Date: Sep. 27, 2007

(87) PCT Pub. No.: WO2006/128720

PCT Pub. Date: Dec. 7, 2006

(65) Prior Publication Data

US 2009/0288443 A1 Nov. 26, 2009

(30) Foreign Application Priority Data

Jun. 2, 2005 (DE) ..... 10 2005 025 451

(51) Int. Cl.
*F25B 39/04* (2006.01)

(52) U.S. Cl. ..... 62/506; 62/509

(58) Field of Classification Search ..... 62/473, 62/474, 509, 512, 476, 506; 165/110, 132
See application file for complete search history.

(56) References Cited

U.S. PATENT DOCUMENTS 5,159,821 A * 11/1992 Nakamura ..... 62/509
5,546,761 A * 8/1996 Matsuo et al. ..... 62/509
5,666,791 A * 9/1997 Burk ..... 62/474
5,992,174 A * 11/1999 Mittelstrass ..... 62/474
6,279,341 B1 8/2001 Incorvia et al.
6,430,945 B1 * 8/2002 Haussmann ..... 62/117
6,622,517 B1 * 9/2003 Whitlow et al. ..... 62/474
6,629,560 B2 * 10/2003 Kaspar et al. ..... 165/41
6,694,773 B1 * 2/2004 Snow et al. ..... 62/510
7,121,114 B2 * 10/2006 Forster et al. ..... 62/509

(Continued)

FOREIGN PATENT DOCUMENTS

AU 75900/94 5/1995

(Continued)

*Primary Examiner*—Mohammad M Ali
(74) *Attorney, Agent, or Firm*—Harness, Dickey & Pierce, PLC

(57) ABSTRACT

In a condenser for an air conditioning system, in particular for motor vehicles, comprising a condensing section (1*b*) and a supercooling section (1*c*) which is arranged above the condensing section, comprising an approximately tubular modulator (2) which is divided by a separating wall (2*b*) into a lower section (2*c*), which is connected to the condensing section (1*b*), and an upper section (2*d*), which is connected to the supercooling section (1*c*), comprising an ascending pipe (4) between the lower and upper sections of the modulator, and comprising a container (7) for desiccant in the lower section (2*c*) of the modulator, the modulator (2) is provided at the upper side with a plug (6), it being possible for the separating wall (2*b*) with the desiccant container to be removed upwards out of the modulator once the plug has been detached from the interchangeable unit.

10 Claims, 4 Drawing Sheets

U.S. PATENT DOCUMENTS

| | | | | |
|---|---|---|---|---|
| 2002/0046571 | A1* | 4/2002 | Bernini | 62/474 |
| 2005/0072184 | A1 | 4/2005 | Operschall | |
| 2005/0103047 | A1* | 5/2005 | Forster et al. | 62/509 |
| 2005/0126214 | A1* | 6/2005 | Knecht et al. | 62/509 |

FOREIGN PATENT DOCUMENTS

| | | | |
|---|---|---|---|
| DE | 199 12 381 | A1 | 9/2000 |
| DE | 102 50 384 | A1 | 5/2003 |
| DE | 103 45 921 | A1 | 5/2005 |
| EP | 0 480 330 | A2 | 4/1992 |
| FR | 2 764 680 | A1 | 12/1998 |

* cited by examiner

CONDENSER FOR AN AIR CONDITIONER

CROSS-REFERENCE TO RELATED APPLICATION

This application is a 371 U.S. National Stage of International Application No. PCT/EP2006/005295, filed Jun. 2, 2006. This application claims the benefit of German Application No. 10 2005 025 451.9, filed Jun. 2, 2005. The disclosures of the above applications are incorporated herein by reference.

The invention relates to a condenser for an air conditioner, in particular for motor vehicles.

It is known from EP 480 330 to construct a condenser for an air conditioner having a top condensing portion, through which gaseous refrigerant flows, and a supercooling portion arranged therebelow, through which the condensed liquid refrigerant flows which is routed to an expansion valve. Laterally at the condenser, which consists of a board-shaped tubular ribbed block, or at a distance therefrom, a tubular modulator is provided, in which a drying agent can be arranged for absorbing humidity contained in the refrigerant.

To enable the charge-air cooler to be arranged in the flow direction of the air in front of the condenser in the lower area thereof, as used in particular for diesel vehicles, a condenser is provided with a top supercooling portion, below which the condensing portion is arranged. In this way, the supercooling portion is not impacted by the heat emission of the charge-air cooler.

To simplify the assembly and maintenance of the condenser in the case of a condenser having a top supercooling portion, according to the invention a sealing plug is provided, preferably at the top end of the modulator. After removal of the sealing plug, a partition dividing the modulator into an upper and a lower portion, and a drying agent container mounted thereon, can be withdrawn upwards from the modulator, preferably together with a standpipe. Here, the partition with the drying agent container and the standpipe forms a replaceable unit inserted in the modulator, by means of which on the one hand the assembly of the condenser, and on the other hand its maintenance, is simplified and carried out with a low expenditure of time.

Figure 1:
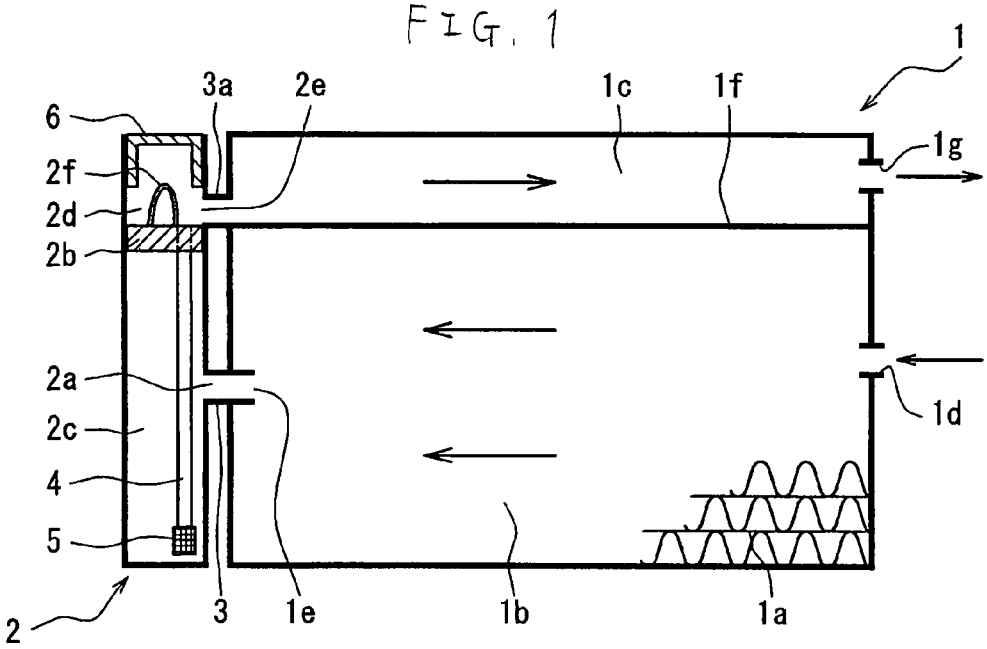

An exemplary embodiment of the invention is explained in more detail below with reference to the drawing, in which FIG. 1 shows schematically a view of a condenser with a top supercooling portion and a replaceable unit in the laterally arranged modulator, FIG. 2 a view of the condenser with the laterally arranged modulator and replaceable unit, FIG. 3 embodiments of replaceable units for the modulator, FIG. 4 a modified embodiment of the condenser, FIG. 5 a practical embodiment of the replaceable unit, and FIG. 6 a tool for withdrawing the replaceable unit from the modulator.

FIG. 1 shows a board-shaped condenser 1, having an approximately rectangular shape and constructed of horizontally extending ribbed tubes 1*a* for the refrigerant, wherein seen vertically to the plane of the drawing, air flows through the condenser between the ribbed tubes 1*a*. The condenser 1 has a lower condensing portion 1*b*, through which gaseous refrigerant flows, and thereabove, partitioned from the condensing portion 1*b* by a partition 1*f*, a supercooling portion 1*c* through which condensed liquid refrigerant flows. The gaseous refrigerant is supplied through an inlet opening 1*d* to a side of the condensing portion 1*b* and flows through the horizontal ribbed tubes 1*a* to an outlet opening 1*e* on the opposite side. Both the inlet opening 1*d* and the outlet opening 1*e* are arranged at a distance from the lower end of the condensing portion 1*b*. In the construction according to FIG. 1, to reduce the loss in pressure with respect to a flow guide formed in a serpentine shape in the condensing portion 1*b*, the gaseous refrigerant flows horizontally between inlet and outlet opening.

However, in the construction according to the invention, it is also possible to provide a serpentine-shaped gas guide in the condensing portion between inlet opening 1*d* and outlet opening 1*e*.

A modulator 2, formed tubular and preferably having a diameter in the order of magnitude of the thickness of the board-shaped condenser 1, is joined to the outlet opening 1*e* of the condensing portion 1*b*. This tubular modulator preferably extends over the height of the condenser 1, wherein a joining pipe 3 to the outlet opening 1*e* of the condensing portion 1*b* opens out at approximately the same height in the modulator 2 at 2*a*, so that a reservoir for liquid refrigerant is formed in the modulator below the mouth 2*a*, in which area refrigerant can collect.

The modulator 2 is divided by a partition 2*b* into a lower portion 2*c* and an upper portion 2*d*, wherein the partition 2*b* lies approximately on the level of the partition 1*f* between condensing portion 1*b* and supercooling portion 1*c*. The upper portion 2*d* of the modulator is joined by a joining pipe 3*a* to the supercooling portion 1*c* of the condenser 1. This joining pipe 3*a* is preferably located directly over the partitions 2*b* and 1*f* or in the lower area of the upper portion 2*d* of the modulator and in the lower area of the supercooling portion 1*c* of the condenser. A standpipe 4 leads through the partition 2*b* from the upper portion 2*d* of the modulator into the lower area of the lower portion 2*c*. The standpipe 4 preferably ends at a small distance from the bottom of the modulator 2. The condensed refrigerant is discharged from the supercooling portion 1*c* through an outlet opening 1*g*, from which a pipe (not shown) leads to an expansion valve. The refrigerant supplied from the condensing portion 1*b* through the standpipe 4 to the modulator is led upwards into the supercooling portion 1*c*, in which the liquid refrigerant undergoes systematic heat removal.

At the lower end of the standpipe 4, a filter 5 can be provided (FIGS. 1, 4, 3*b* and 3*c*), through which refrigerant flows before being conveyed through the standpipe into the supercooling portion 1*c*. It is also possible to arrange the filter at the upper end of the standpipe 4 or at the upper portion 2*d*, as shown in FIGS. 2, 3*a* and 5, wherein the filter located at the top is designated by 5'.

Figure 2:
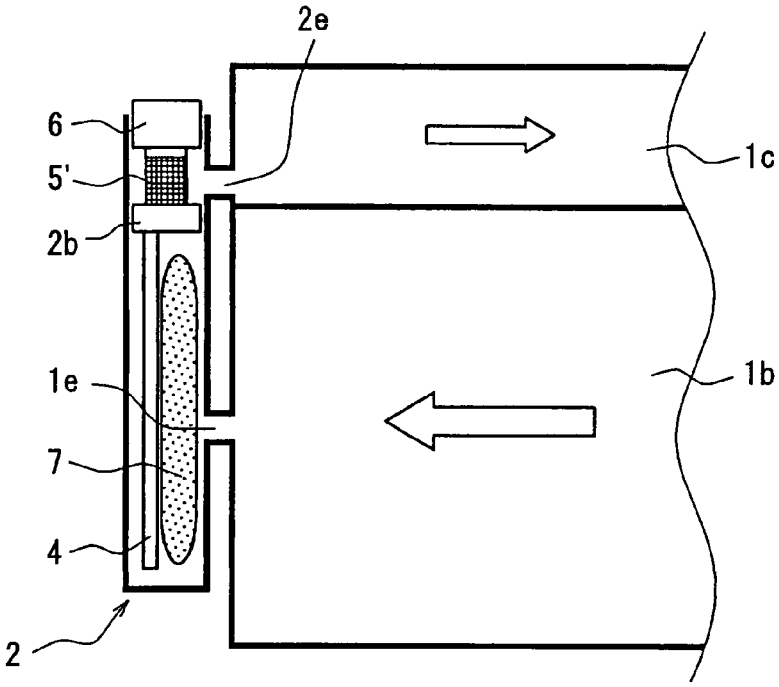

FIG. 2 schematically shows a construction in which the filter 5' is arranged between the outlet opening of the standpipe 4 and the joining opening 2*e* to the supercooling portion 1*c*, such that the refrigerant rising up through the standpipe 4 must flow through the filter 5' on its way to the supercooling portion 1*c*.

FIG. 2 schematically shows an embodiment in which the modulator 2 is attached directly at the lateral face of the condenser 1, so that the modulator 2 is divided from the condensing portion 1*b* and the supercooling portion 1*c* of the condenser only by a partition. In this case, a joining pipe 3, 3*a* between the individual portions of the condenser and the modulator is omitted, so that only a joining opening 1*e* between condensing portion 1*b* and lower portion 2*c* of the modulator and a joining opening 2*e* between upper portion 2*d* of the modulator and supercooling portion 1*c* of the condenser remain in the common partition.

The modulator 2 is sealed at the top by a sealing plug 6 which can be screwed into the tubular modulator, for example, by means of a thread. The partition 2*b* can be provided with a handle bracket 2*f* (FIG. 3*b*, 3*c*) or another means which facilitates the withdrawal of the partition 2*b* from the modulator after removal of the sealing plug 6. The partition 2*b* is provided on the outer circumference with a sealing ring, so that the upper portion 2*d* is sealed with respect to the lower portion 2*c* in the modulator. This partition 2*b* is joined to the standpipe 4 and a receptacle, for example a bag 7 or a cartridge for drying agent, so that these components 2*b*, 4, 5 and 7 form a replaceable unit which can be withdrawn from the modulator 2 from above after releasing the sealing plug 6. The seal on the outer circumference of the partition 2*b* is preferably joined to the modulator 2 in such a way that it can be removed therefrom with the replaceable unit, so that it can be replaced if necessary. However, it is also possible to provide a seal in the modulator 2, into which the partition 2*b* is inserted. In the construction with a seal at the partition 2*b*, a seal seat is preferably provided on the inner circumference of the modulator 2.

The bag 7 with drying agent can be hung at the lower side of the partition 2*b* or detachably fixed on the circumference of the standpipe 4.

For reinsertion, the replaceable unit can be inserted into the modulator and then the modulator can be sealed by the sealing plug 6. According to another embodiment, a spacer for the partition can be provided at the sealing plug 6, and after insertion of the replaceable unit and tightening of the sealing plug, this spacer positions the partition 2*b* with the seal on its circumference in the predetermined position, wherein the partition abuts at a seal seat in the modulator.

Figure 3:
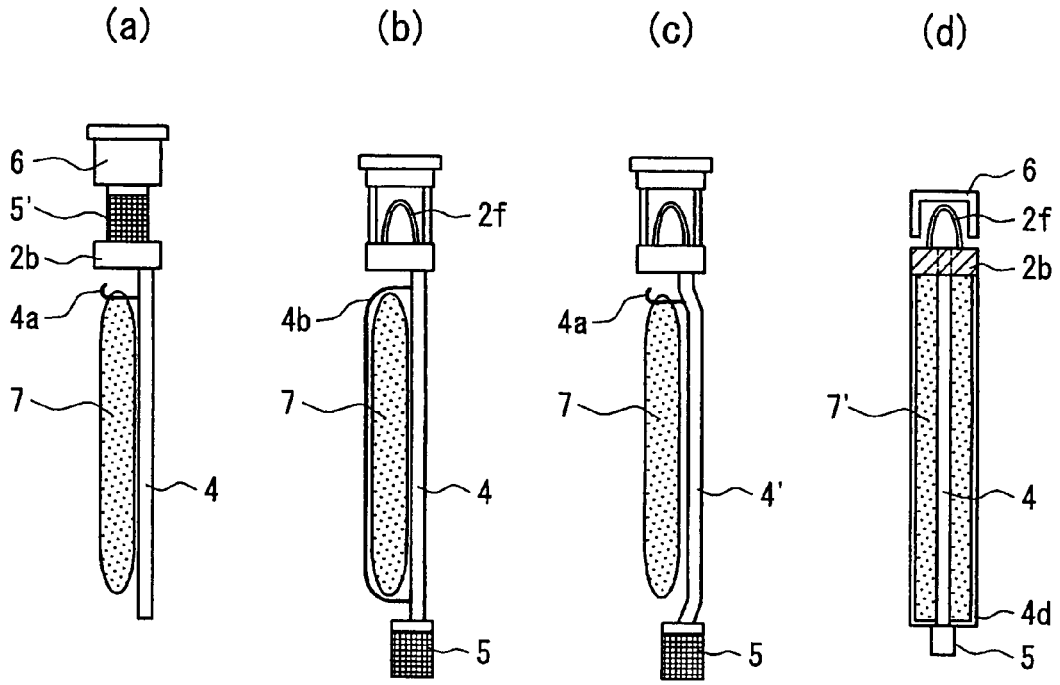

FIG. 3 shows different constructions of replaceable units. According to FIGS. 3*a* and 3*c*, a bag 7 is hung on a hook 4*a* fixed to the standpipe 4. In the embodiment according to FIG. 3*b*, a mounting bracket 4*b* into which the bag 7 can be inserted is formed at the standpipe 4.

FIG. 3*c* shows an embodiment with a curved standpipe 4' or a standpipe provided with a salient, wherein the bag 7 is hung on a hook at the standpipe 4'. By means of this configuration, the diameter of the modulator 2 can be kept small. Instead of a hook, a clip connection can also be provided between bag 7 and standpipe 4 or partition 2*b*.

It is also possible to provide a cable clip or a similar fixing means to join the bag 7 to the standpipe 4.

According to FIG. 3*d*, a tubular bag 7' or a tubular cartridge for drying agent can be provided, through the middle of which the standpipe 4 extends, so that the tubular bag 7' with drying agent can be displaced from below up onto the standpipe 4. As a retainer, a disc 4*d* can be screwed onto the lower end of the standpipe 4. In this embodiment, the filter 5 with the disc 4*d* is detachably joined to the standpipe 4.

According to a further embodiment, the receptacle 7 with drying agent can be fixedly joined to the standpipe, wherein only the drying agent in the receptacle is replaceable or wherein the receptacle 7 is replaceable with the standpipe and filter 5, when the drying agent is to be replaced.

Figure 4:
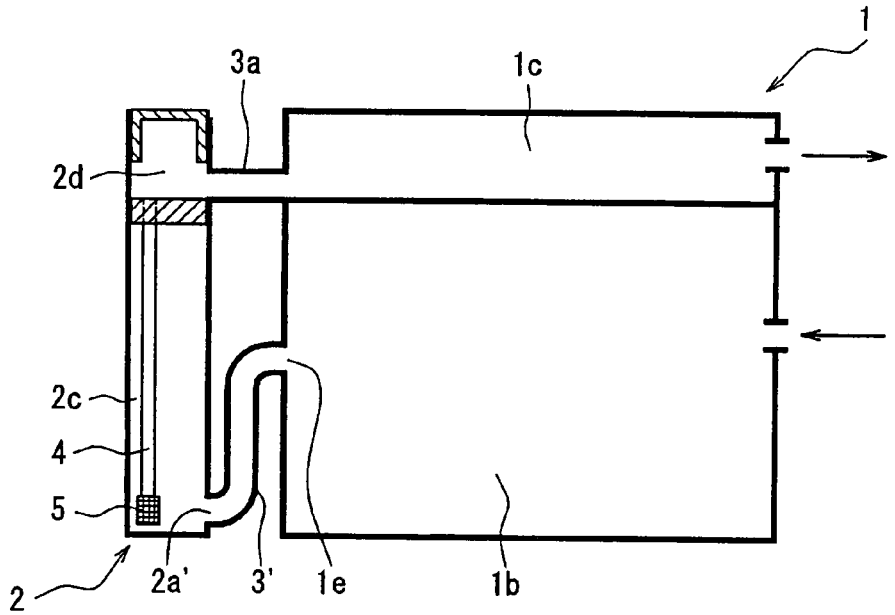

FIG. 4 shows a modified construction, in which the pipe 3' leading from the outlet opening 1*e* to the modulator 2 at a distance from the bottom of the condensing portion, opens into the lower area of the modulator at 2*a'*. In this construction, too, a reservoir for liquid refrigerant is formed in the modulator up to the level of the outlet opening 1*e* at the supercooling portion.

The advantage of arranging the outlet opening 1*e* at a distance over the bottom of the modulator 2 for forming a reservoir for liquid refrigerant in the modulator, consists in that backflow of liquid refrigerant into the condensing portion is prevented when the air conditioner is not in use. Such a backflow of liquid refrigerant in the non-operative state of the air conditioner could lead to damage on re-operation.

The advantage of the replaceable unit lies mainly in the possibility of exchanging the components filter 5 and standpipe 4, which are at risk of fouling. On exchanging the replaceable unit, the pressure loss on the refrigerant side can be reduced, which is caused mainly by the outlet opening 1*e* at the condensing portion and is increased by fouling of the standpipe 4 and the filter 5. It is above all when the filter 5 is arranged at the upper end of the standpipe 4, as shown in FIGS. 2, 3*a* and 5, that deposits can occur in the area of the standpipe 4, which can be quickly removed by means of an exchange.

Figure 5:
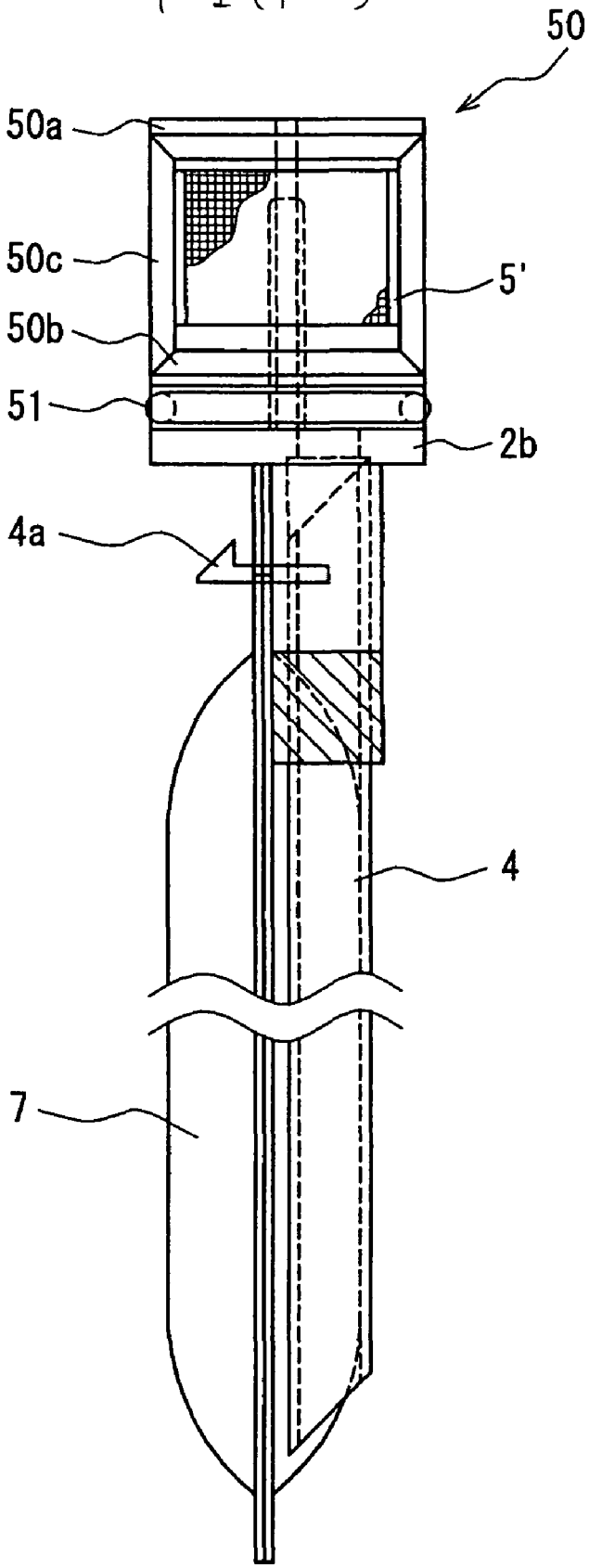

FIG. 5 shows a practical embodiment of a replaceable unit, wherein for identical or corresponding components, the same reference numerals are used as in the preceding Figures. In this embodiment, a cage-shaped filter housing 50 is arranged over the partition 2*b*, and a sealing ring 51 is provided between the filter housing and the partition 2*b*, to ensure sealing between the upper and lower portion in the modulator. The filter housing 50, which is laterally open for discharging the refrigerant, is fixedly joined to the partition 2*b* and the standpipe 4. In this construction, the partition 2*b* can be formed integrally with the filter housing 50. The sealing ring 51 can be inserted in a circumferential groove between partition 2*b* and filter housing 50. The filter housing 50 can, for example, be constructed of an upper disc 50*a* and a lower disc 50*b*, which are joined to one another by stays 50*c*.

The filter housing 50 can be provided with a handle means 2*f*. Preferably, recesses are provided on the upper side of the filter housing 50, in which for example resilient hooks 61 of an extraction tool 60 can be snap-inserted when the sealing plug 6 is removed from the modulator 2. The hooks engage a shoulder in the recess in the filter housing, so that the replaceable unit can be withdrawn upwards from the modulator 2 by means of the tool 60.

Figure 6:
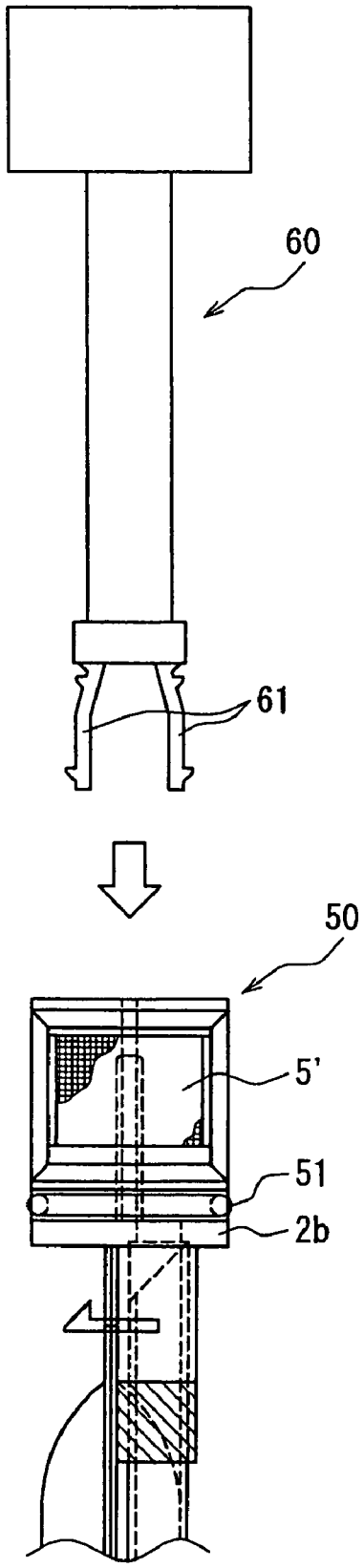

FIG. 6 shows an embodiment of such a tool 60, whose hook 61 is arranged in a U-shape and is resiliently deformable in the radial direction for engaging a shoulder in the filter housing 50 for withdrawal. However, a tool formed in another way can also be provided.

The replaceable unit comprises at least the partition 2*b* and the receptacle 7 with the drying agent. Preferably, the standpipe 4 with the filter 5 is also integrated into the replaceable unit.

It is also possible to form the replaceable unit in two parts, so that after removing the sealing plug, first one part, for example, the partition, is withdrawn from the modulator, and then the further members are removed from the modulator.

An embodiment is also possible in which a sealing plug is provided at the lower side of the modulator 2, so that after releasing the sealing plug, the replaceable unit can be withdrawn downwards from the modulator. Here, the standpipe 4, for example, can serve as a handle means by which the partition can be removed from the modulator. However, it is also possible to have a handle bracket protruding downwards as a handle means. For such an embodiment, it is also preferable to provide a stop at which the partition or a member of the replaceable unit abuts on insertion.

The invention claimed is:

1. A condenser for an air conditioner, in particular for motor vehicles, comprising a condensing portion and a supercooling portion arranged over the condensing portion, and an approximately tubular modulator partitioned by a partition into a lower portion joined to the condensing portion and an upper portion joined to the supercooling portion, a standpipe between the lower and upper portions of the modulator and a drying agent receptacle below the partition in the lower portion of the modulator, wherein the modulator is provided with a sealing plug and the partition with the drying agent receptacle is removable from the modulator after releasing the sealing plug.

2. The condenser according to claim 1, wherein the standpipe is joined to the partition.

3. The condenser according to claim 1, wherein a handle means is joined to the partition, by means of which, after removing the sealing plug the partition can be withdrawn from the modulator.

4. The condenser according to, claim 1, wherein at the partition a seal is provided, which is removable from the modulator with the partition.

5. The condenser according to claim 1, wherein at the lower end of the standpipe or in the upper portion of the modulator, a filter is provided at the standpipe.

6. The condenser according to claim 1, wherein a filter housing is fixed over the partition.

7. The condenser according to claim 6, wherein the filter housing has on the upper side an engagement means for a tool for withdrawing the replaceable unit formed by the filter housing the partition and the standpipe.

8. The condenser according to claim 1, wherein the drying agent contained in a bag is detachably fixed at the standpipe.

9. A condenser for an air conditioner, in particular for motor vehicles, comprising a condensing portion and a supercooling portion arranged over the condensing portion, and an approximately tubular modulator, which is divided by a partition into a lower portion joined to the condensing portion, and an upper portion joined to the supercooling portion, and a standpipe between the lower and upper portions of the modulator, wherein a connection between the modulator and the condensing portion or an outlet opening at the condensing portion is arranged at a distance over the bottom of the modulator, for forming a reservoir for the refrigerant in the modulator.

10. The condenser according to claim 9, wherein the condensing portion has ribbed tubes extending horizontally, through which the flow of gaseous refrigerant is led horizontally in the whole of the condensing portion.

* * * * *